US006766620B2

(12) United States Patent
Robbins

(10) Patent No.: US 6,766,620 B2
(45) Date of Patent: Jul. 27, 2004

(54) BUILDING LEVELLING SYSTEM

(76) Inventor: Robert Ralph Robbins, 62 Thatcher Drive, Winnipeg Manitoba (CA), R3T 2L3

( * ) Notice: Subject to any disclaimer, the term of this patent is extended or adjusted under 35 U.S.C. 154(b) by 9 days.

(21) Appl. No.: 10/166,107

(22) Filed: Jun. 11, 2002

(65) Prior Publication Data

US 2003/0014923 A1 Jan. 23, 2003

(30) Foreign Application Priority Data

Jun. 10, 2002 (CA) ..... 2,353,243

(51) Int. Cl.[7] ..... E02D 19/10; E02D 31/02

(52) U.S. Cl. ..... 52/169.5; 52/169.14; 52/302.3; 52/741.1; 405/36; 405/54; 405/129.5; 405/229

(58) Field of Search ..... 52/169.5, 302.1, 52/169.14, 126.1, 302.3, 741.1; 405/36–38, 53–54, 129.5, 129.85, 229; 417/40–44, 53, 63

(56) References Cited

U.S. PATENT DOCUMENTS 4,456,432 A * 6/1984 Mannino ..... 417/2
4,514,112 A * 4/1985 Sano et al. ..... 405/269
4,879,852 A 11/1989 Tripp
4,949,626 A * 8/1990 Townsend et al. ..... 454/341
5,314,313 A * 5/1994 Janesky ..... 417/63
5,551,797 A * 9/1996 Sanford ..... 405/36
5,931,603 A * 8/1999 Swain et al. ..... 405/229
6,082,932 A 7/2000 Anderson

FOREIGN PATENT DOCUMENTS

GB 1178013 A 1/1970
WO WO 99/21802 A1 6/1999

* cited by examiner

*Primary Examiner*—Winnie Yip
(74) *Attorney, Agent, or Firm*—Ryan W. Dupuis; Adrian D. Battison; Michael R. Williams

(57) ABSTRACT

A building levelling system is provided for a building having a basement or foundation supported on expansive soil. A water management system is included for maintaining water in the expansive soil at a level adjacent the foundation to saturate the soil with water and thereby prevent the cyclic shrinking and expanding of the soil when the soil is normally repeatedly dried and wetted, causing damage to the building supported thereon. An injection system may also be included for injecting water into the soil spaced well below the foundation to lift a foundation which has already settled significantly due to shrinkage of expansive soil upon which it is supported. The injection system includes a level sensing mechanism for determining when a level of water in a prescribed area of the expansive soil falls below a reference level of the system and injectors for feeding water into that area.

20 Claims, 6 Drawing Sheets

BUILDING LEVELLING SYSTEM

FIELD OF THE INVENTION

The present invention relates to a building levelling system for a building having a foundation supported on expansive soil and more particularly to a building levelling system for preventing uneven settling of a building supported on expansive soils.

BACKGROUND

Many homes are troubled with settlement which is due to changes in the moisture content of the soil. The majority of the land area of North America includes a type of soil referred to herein as expansive soil which swells when it is wetted and shrinks as it is dried.

Soils with the potential to shrink and swell are found throughout the United States, Canada and in almost all parts of the world. Soils with this shrink and swell potential create difficult performance problems for buildings constructed on these soils because as the soil water content increases, the soil swells and heaves upward and as the soil water content decreases, the soil shrinks and the ground surface recedes and pulls away from the foundation walls.

Expansive soils are also known as swelling soils, heaving soils, volume change soils and shrinkable soils. By whatever name these soils are clay soils. Sometimes the clay has been compressed by great weight at some time in its geologic past and is called a shale, which can also be expansive. Nearly all clay soils swell when they get wetter and shrink when they get drier. Although there are many types of clay minerals, three that are most commonly encountered are those known as kaolinite, illite and smectite.

When building on expansive soil it is desirable to keep the water content of the soil consistent, however this can be difficult in some climates, for example semi-arid climates. Many dwellings have been built with concrete foundations resting on concrete footings. A weeping tile system has been installed which, in past construction, drained rainwater away into the sanitary sewer system and, more recently, drains water into a sump pit from which it is pumped outdoors away from the house.

In this way, water seepage is tidily disposed of without any flooding of basements. However, this system tends to dry out the soil to elevations even below the footings due to the capillary action of the soil. Settlement takes place as the soil dries beneath the footings.

In colder climates, for example Canada and the northern United States, further drying of the soil is caused by the phenomenon known as stack effect. During winter months the temperature difference between the inside of a building and outdoors can be 100 to 110 degrees Fahrenheit. The greater this temperature difference, the greater is the difference between the densities of inside and outdoor air.

Under these conditions, there is a small pressure difference between the inside of a heated building and the outdoors, this difference being greatest at the lowest elevation of the building. This difference causes outdoor air to leak into the lower regions of this building through doors, windows and other openings in the structure while heated air escapes at upper elevations through windows and other openings such as a roof space trap door.

This is stack effect and can be observed in a two story house equipped with leaky horizontal sliding windows. In severe weather, the windows on the main floor will be clear while the second story windows are partially or fully fogged up with moisture and ice. In this case, dry outside air enters the building through the main floor windows while moist warm air exits through the second story windows. This warm air condenses moisture onto the glass as it cools and leaks out to the outdoors. Homes equipped with fossil fuel fired heating systems (natural gas, propane or fuel oil) have chimneys which add to this stack effect as they exhaust combustion products from the heating equipment.

The basement of the structure is the lowest elevation where stack effect is at its greatest. During the heating season, cold, dry outdoor air passes down the exterior of the basement walls through cracks in the soil and enters the building through the weeping tile system. In the upper regions of the frozen soil, ice crystals in the soil sublime into the air that is passing downward causing shrinkage of the soil. At lower levels, moisture is also picked up by this outdoor air so that the above shrinkage occurs even to the footings and below due to the capillary action of the clay thereby resulting in settlement. A gap between the soil and outer sides of the concrete walls of the basement foundation are known to occur during prolonged severe weather due to this drying action. As little as a ¼ inch may not seem like much but if it exists all the way around the building it is a significant opening. An average size house may have a perimeter of 158 feet for example, which multiplied by the ¼ inch gap computes to 3.3 square feet of opening.

So far, conditions which tend to dry the soil uniformly have been described. There are conditions which tend to dry the soil differentially.

During the last 40 to 50 years, the automobile has become firmly entrenched in our lifestyle so that many of our homes are complete with attached garages that house two and, in some cases, three automobiles. Many such garages have front walls that project 4 feet to 6 feet beyond the front wall of the house and may include a roof which extends over the front entrance pad. This roof is equipped with eaves troughs which conduct rainwater away to a remote location thereby providing a sheltered, dry front entrance for the dwelling.

This arrangement causes a wide range of water absorption by the soil. Before such a house was built, the water content of the soil was likely uniform so that shortly after its completion, differential shrinkage and settlement were underway. Many such houses are one to two inches lower at the corner of the house adjoining the garage. Along the length of the common wall between the house and garage the expansive soil is also denied rainwater which is drained away by the eaves troughs and down pipes to locations remote from the house.

Trees are a significant part of landscaping and planning should locate them far enough from dwellings to minimize their affect on the moisture content of the soil at the dwelling. A 22 foot caliper tree for example may require 45 gallons of water per day. With a root system extending twice as far as the branches maximum separation from dwellings is desirable.

When damage to the foundation results, in many cases, owners opt for the lesser cost of repair which involves leaving the foundation and concrete floor in the settled state. The contractor lifts the house with jacks in the basement using beams to heave the joists upward to a level state. Shims are then installed to support the wood joists.

A considerably more expensive arrangement involves getting under the footings, raising them to level and installing friction piles. Friction piles however are known to sink. The only trouble free installation is piles to refusal, for example to bedrock or hardpan. This type of repair will more than likely require replacement of the basement floor. As the soil under the footings dries out so does the soil under the basement floor slab. If footings only are raised, the periphery of the floor slab will also be raised with resultant cracking of the slab. This is so because typical construction does not include a structural floor.

Repairs done that are less than totally supporting the building on piles to refusal plus a structural basement floor quite likely will not prevent further settlement or differential movement as the moisture content continues to be depleted. Furthermore, the above noted repairs involve considerable cost and disruption to the owners and occupants of the building.

SUMMARY

According to one aspect of the present invention there is provided a building levelling system for a building having a basement with a floor and footings supported on expansive soil, the building levelling system comprising:

a water management system arranged to maintain water in the expansive soil at a level adjacent the basement floor, the water management system including:

a drain mechanism for draining water from the expansive soil when the level of water rises above a prescribed upper limit of the water management system; and a feed mechanism for feeding water to the expansive soil when the level of water falls below a prescribed lower limit of the water management system.

When levelling a building which has settled due to the drying of expansive soils upon which it is supported, the use of the building levelling system is considerably less costly than current practices in which the building is jacked up and the foundation is extended or replaced to accommodate for shrinkage of the soils upon which it is supported. Feeding the expansive soil with water permits the floor and footings to rise simultaneously minimizing the need for replacement of the floor and reducing the possibility of costly damage due to excavation which would otherwise likely be required. The building leveling system thus provides a minimum of inconvenience to owners and occupants of a building which has settled and requires repair.

The prescribed upper limit is preferably below a top surface and above a bottom surface of the basement floor with both the upper and lower limits being situated spaced apart. The lower limit is preferably above the bottom surface of the basement floor, however the lower limit may be only above the drainage tile below the basement floor while still preventing stack effect.

The feed mechanism preferably includes a supply of water and level sensor arranged to determine when the level falls below the prescribed lower limit of the water management system. The supply of water may be either the fresh water supplied to the building or grey water from the building which has been appropriately pressurised before being supplied to the system. A filter system would also be required when using grey water.

The level sensor may comprise a float valve coupled to the water supply and arranged to be supported adjacent the basement floor. The float valve can be replaced however with any suitable mechanical equivalent such as a float sensor controlling a solenoid actuated valve on the water supply. The level sensor is preferably adjustable over a range of selected levels.

When the basement floor has a catch basin with a drain adjacent a bottom end of the catch basin, the drain mechanism may comprise a riser coupled to the drain to extend upwardly from the bottom end of the catch basin. The prescribed upper limit may thus comprise an open top end of the riser.

When the basement floor has a sump pump in a sump coupled to the catch basin, the drain mechanism may include a level sensor for determining a level of water in the sump and a sensor activated switch for operating the sump pump only when the level of water in the sump exceeds the prescribed upper limit. Preferably there is provided an override switch for overriding the sensor activated switch and operating the pump within its factory set upper and lower limits.

There may be provided a level sensing mechanism for determining when a level of water in a prescribed area of the expansive soil falls below a reference level of the system and a water injection system for feeding water into the prescribed area of the expansive soil below the basement floor when the level sensing mechanism determines that the level of water in the expansive soil has fallen below the reference level.

The water injection system is preferably arranged to extend through the basement floor to inject the water into the prescribed area of the expansive soil at a location spaced below the basement floor.

The level sensing mechanism may be arranged to determine when a level of water in any one of plural prescribed areas of the expansive soil falls below a reference level of the system. The water injection system in this arrangement would be arranged to inject water into one of the prescribed areas when a level of water in said one of the prescribed areas falls below the reference level.

The water injection system is preferably arranged to inject water into plural spaced locations within each of the plural prescribed areas.

According to a second aspect of the present invention there is provided a building levelling system for a building having a foundation supported on expansive soil, the building levelling system comprising:

a level sensing mechanism for determining when a level of water in a prescribed area of the expansive soil falls below a reference level of the system; and a water injection system for feeding water into the prescribed area of the expansive soil below the foundation when the level sensing mechanism determines that the level of water in the expansive soil has fallen below the reference level of the system.

The water injection system is preferably arranged to inject the water into the prescribed area of the expansive soil at a location spaced below the foundation.

The level sensing mechanism may be arranged to determine when a level of water in any one of plural prescribed areas of the expansive soil falls below a reference level of the system. The water injection system would accordingly be arranged to inject water into one of the prescribed areas when a level of water in said one of the prescribed areas falls below the reference level.

The water injection system is preferably arranged to inject water into plural spaced locations within each of the plural prescribed areas.

BRIEF DESCRIPTION OF THE DRAWINGS

In the accompanying drawings, which illustrate an exemplary embodiment of the present invention.

DETAILED DESCRIPTION

Figure 1:
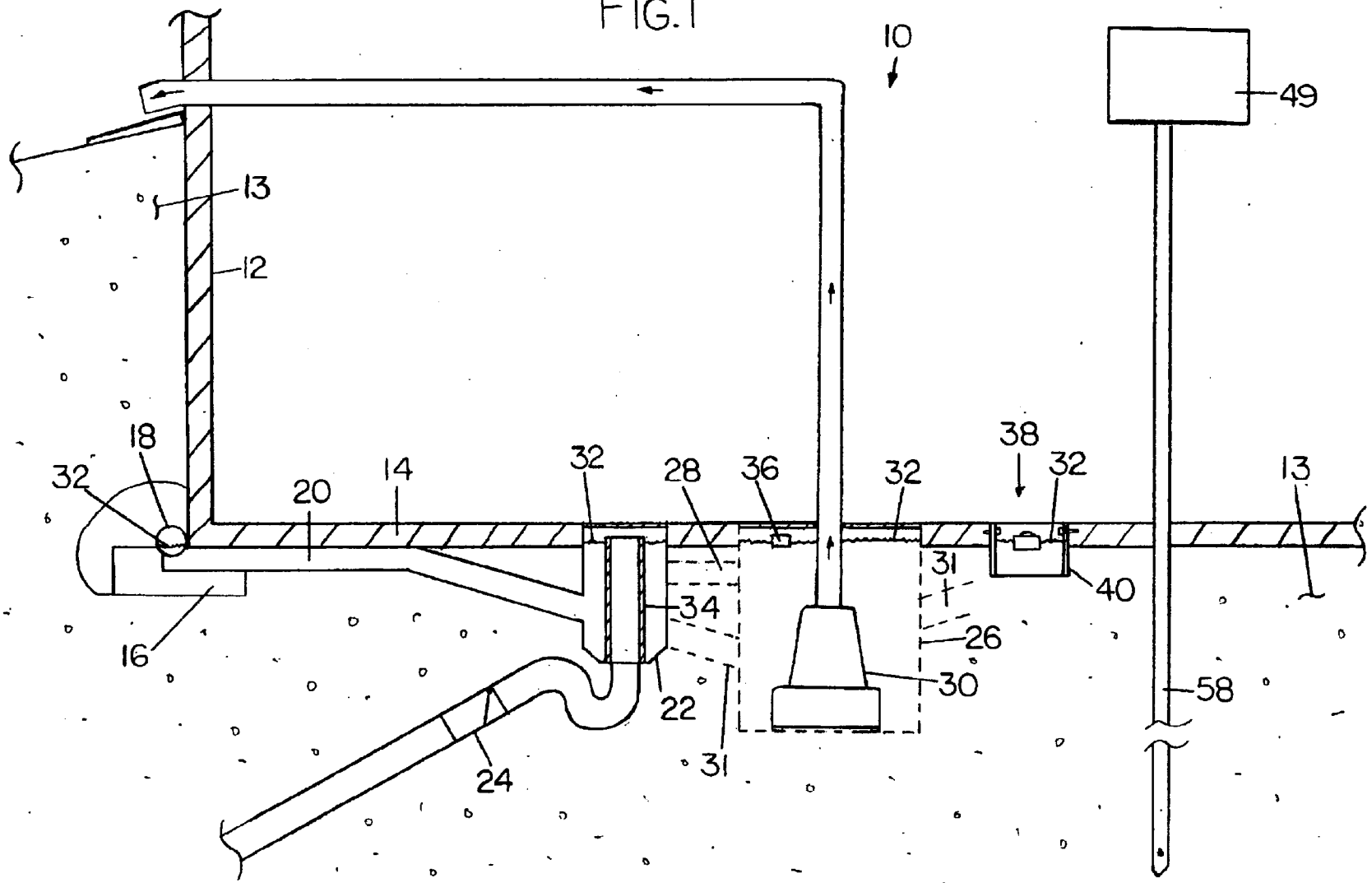
FIG. 1 is a schematic of the components of the building levelling system installed in a basement floor.

Referring initially to FIG. 1 there is illustrated schematically a building leveling system generally indicated by reference numeral 10. The system is intended for use with buildings having a foundation, for example basement walls 12, supported on expansive clay soil 13.

The basement walls 12 are supported on the soil 13 by footings 16 thereunder. A floor 14 is included, resting on granular fill within the walls 12 as in a typical basement construction. Buried within the surrounding soil 13 are weeping tiles 18 which surround the outer basement walls adjacent the footings 16 upon which the basement floor is partially supported. The tiles 18 drain through pipes 20 which direct water to a central location beneath the basement floor 14 where a catch basin 22 receives the water for draining excess water to city sewer lines. The catch basin 22 is a reservoir formed in the basement floor having a drain opening in a bottom end thereof which drains to the sewer typically through a backup valve 24.

As shown in dotted line in FIG. 1 a sump pit 26 may additionally be provided having an overflow pipe 28 coupling the catch basin 22 to the sump pit 26 where a pump 30 in the sump pit pumps away the excess water overflowing from the catch basin through the overflow pipe to the sump pit. The pump 30 normally pumps water from below the basement floor to a location above ground exterior from the building.

Alternatively as shown in dotted line also in FIG. 1, in some arrangements the weeping tiles 18 may drain directly to the sump pit 26 by drain pipes 31. In this instance the sump pit 26 is not coupled to a catch basin by overflow pipe 28. A riser 34 thus may not be required in the catch basin as in many arrangements using pipes 31 draining directly to the sump pit. In this instance, a catch basin may not even be provided.

The building levelling system 10 includes a water management system for maintaining a level of water 32 adjacent an underside of the basement floor as shown in FIG. 1. The water level 32 is maintained by the water management system between the top and bottom sides of the basement floor so as not to flood the basement while removing any air spaces adjacent the underside of the floor where stack effect is known to normally dry out the soil there under. If the granular space below the concrete floor is increased, the water level can be maintained below the floor and still be effective as long the water level is still above the drain tile system so as to flood the drain tile system and prevent stack effect.

Houses subject to significant differential settlement will likely have some air spaces below the floor. The elevation difference can be so great that to remove all air spaces the lowest part of the basement floor would be flooded. The water level would be sustained at a level which would not flood any floor area and stack effect would cause air to enter the building through the higher drain tiles. This would dry out the soil around them and lower such higher areas. Eventually such action would level the building at which point any air spaces would be removed.

The water management system includes a drain mechanism in the form of a riser 34 which drains water away from underneath the basement floor when the water level rises above a prescribed upper limit of the water management system. The riser 34 generally comprises a standpipe which is mounted and sealed at a bottom end to the drain at the bottom end of the catch basin 22 to extend upwardly therefrom to an open top end of the standpipe which is spaced one to two inches below the top surface of the basement floor. The open top end of the standpipe defines the upper limit of the system.

When a sump pit 26 is provided, the drain mechanism includes a float sensor 36 mounted within the sump pit adjacent the desired water level 32 to sense the level of the water when the level exceeds the prescribed upper limit of the system. The float sensor 36 then energizes a sensor activated switch on the pump 30 for turning on the pump to pump water away from underneath the basement floor only when the water level exceeds the prescribed upper limit of the system. An override switch on the pump is provided to override the float sensor and sensor activated switch to operate the pump as desired regardless of the water level when it is desired to lower the water level under the floor below the prescribed limits of the system. This is particularly useful when expecting large amounts of water to accumulate due to a storm and the like.

The float sensor 36 may be used in conjunction with the riser 34 when the sump pump and catch basin are connected as illustrated in FIG. 1, however when the weeping tiles drain directly to the sump pump the riser 34 may not be required. The drain mechanism is this instance may only comprise the float sensor 36 controlling the sensor activated switch on the sump pump.

Figure 3:
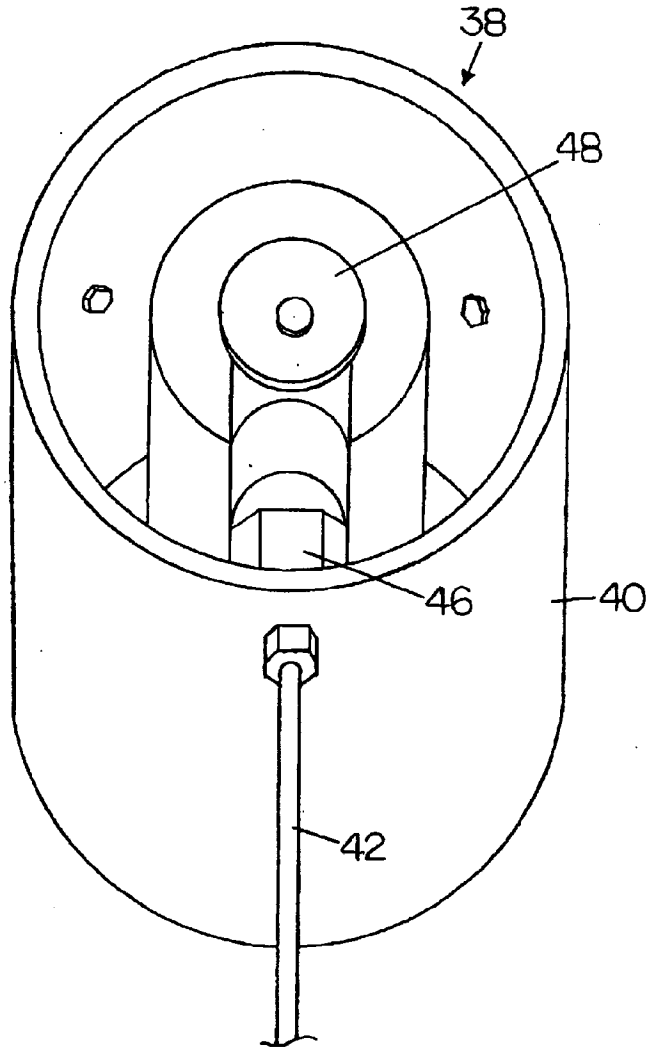
FIG. 3 is a perspective view of the float valve of the feed mechanism.

A feed mechanism is also provided for feeding water to the expansive soil under the foundation when the level of water falls below a prescribed lower limit of the water management system. The feed mechanism includes a well 38 mounted in a hole formed in the basement floor and arranged to allow the level of water 32 to pool therein. The well 38 of the feed mechanism is shown in further detail in FIG. 3. The well 38 generally includes a collar 40 which is fastened to the surrounding floor 14 by a set of screws which extend radially outward through the collar so as to engage the surrounding floor. The collar 40 includes an open bottom end which allows the water to rise up therein. A water supply line 42 conducts water to the well 38 from a pressurized source of water 44. The main line from the source of water 44 to which the supply line 42 is connected includes a filter arrangement therein for filtering out any undesirable particles from the water which may plug restricted orifices of the system.

The control of water fed into the well from the water supply line 42 is accomplished by a float valve 46 which includes a float supported on a float arm floating within the water pooled within the well 38 to control actuation of the valve 46 when the water level falls below the prescribed lower limit of the system. The float arm includes a peg for supporting weighted disks 48 thereon to permit the level sensed by the float valve to be adjusted for adjusting the lower limit of the system over a range of selected values by varying the weight of the disks 48 supported on the float arm.

In this arrangement the upper limit of the water management system is determined by positioning the open top end of the riser 34 at the desired level or by positioning the float sensor 36 at an appropriate elevation. The lower limit is adjusted by selecting the weight acting on the float arm of the float valve 46 within the well 38. The upper and lower prescribed limits of the water management system are spaced apart and both located between the top and bottom surfaces of the basement floor 14.

Figure 2:
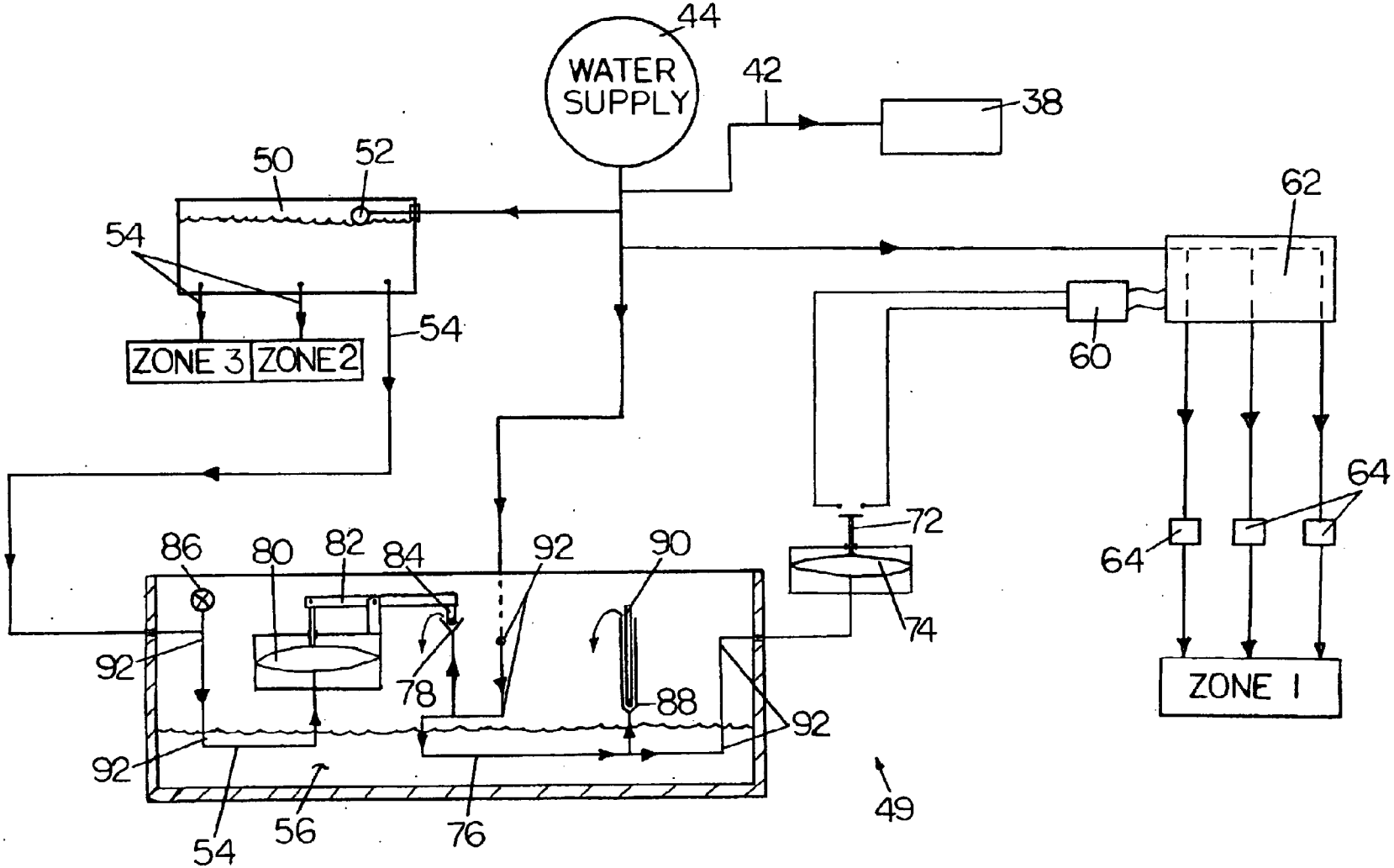
FIG. 2 is a schematic of the injection system of the building levelling system of FIG. 1 shown in greater detail.

Turning now to the remaining figures, the level controls 49 shown schematically in FIG. 2 are illustrated in more detail. The level controls are intended for injecting water deep into the expansive soil in one particular area to raise that area lacking water in relation to another area in the soil below the foundation which supports the building thereon at a higher elevation.

Figure 5:
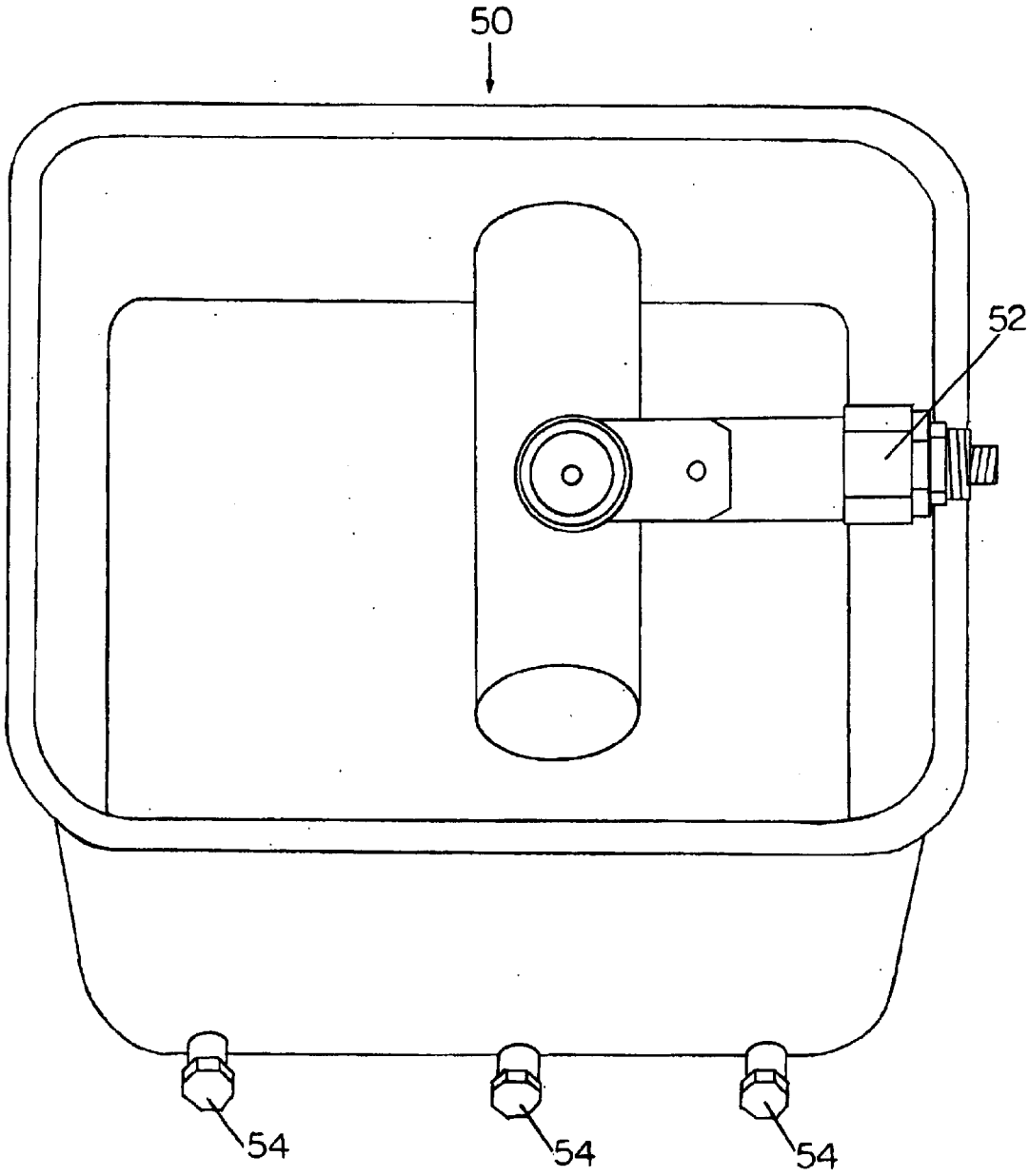
FIG. 5 is a perspective view of the reference reservoir of the building levelling system.

The level control system includes a reference reservoir 50 which receives water from the water supply 44 of the system and maintains the water therein at a consistent level. The reservoir 50, as shown in greater detail in FIG. 5, is intended to be supported on the joists along the ceiling of the basement 12 of the building at the highest point in elevation of the basement where the expansive soil supporting the basement thereon is at its most stable location. The reference reservoir 50 generally comprises a container having a float valve 52 controlling the water introduced into the reservoir from the supply 44. The float valve 52 includes a float arm arranged at an appropriate level to open and close the float valve 52 as required to maintain a consistent water level within the reservoir. Adjacent a bottom side of the reservoir a plurality of control lines 54 are provided. Each control line extends from the reference reservoir 50 to a designated zone of the building foundation.

The components for one of the plural zones or prescribed areas of the expansive soil is illustrated in further detail in FIG. 2. The control line 54 is an open line supplying water from the reference reservoir 50 to a control reservoir 56 of the prescribed area. The control reservoir 56 controls the injection of water deep into the soil of the prescribed area while additional control reservoirs are provided for each of the other plural areas of the system. The control reservoir 56 is arranged to sense the level of water within its designated area in relation to the level of water within the reference area over which the reference reservoir is supported by comparing the elevation of the control reservoir 56 to that of the reference reservoir. The control reservoir is similarly supported to the underside of the joists of the ceiling of the basement 12 at a location above the prescribed area of expansive soil over which that control reservoir governs.

As the control reservoir 56 is raised and lowered in relation to the reference reservoir with expansion and shrinking of the soil thereunder, the head pressure in the control line 54 leading from the reference reservoir to that area changes. A level control within the control reservoir activates injectors 58 which inject water into the soil in the prescribed area when the controls determine that the water level is below that of the reference level. A plurality of the injectors 58 are provided within each prescribed area and are all controlled by the components of the control reservoir 56 for that prescribed area. Each injector generally comprises an elongate tube inserted into the ground through the basement floor to inject water into the soil through the tube at locations spaced well below the foundation.

Pressurized water is supplied to the injectors from the water supply 44 as controlled by a solenoid valve 60. As illustrated in further detail in FIG. 7 the solenoid valve 60 controls the supply of water to a manifold 62 directing the water to all of the individual injectors 58 for that prescribed area. A bank of restricted orifices 64 is provided between each injector 58 and the manifold 62 for metering water to the injectors 58.

Figure 4:
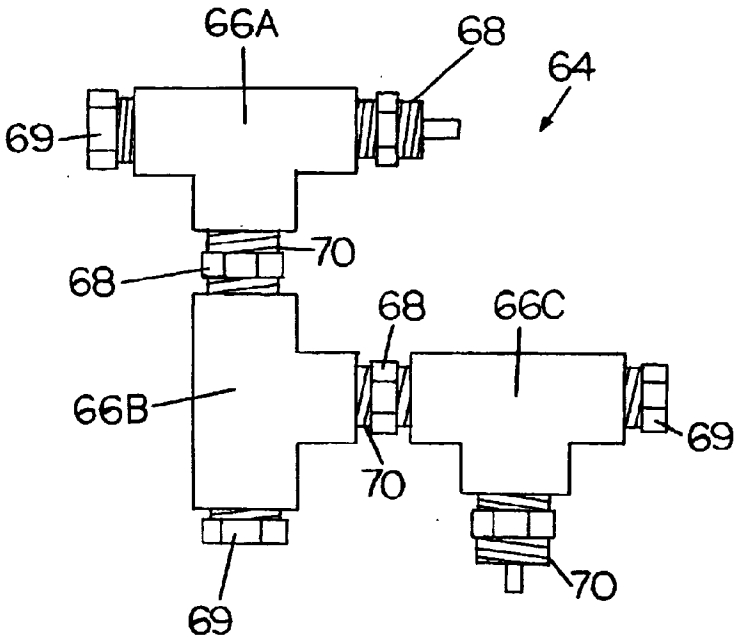
FIG. 4 is a side elevational view of a bank of restricted orifices which acts as a metering device for each of the injectors.

The bank of restricted orifices 64 is illustrated in further detail in FIG. 4 and generally comprises a bank of three fittings 66*a*, 66*b* and 66*c* arranged to be secured on the ceiling joists of the basement. Each of the fittings is T-shaped having an inlet 68 and an outlet 70 coupled to the inlet of the next fitting for passing the water therethrough in series. Within each fitting there is provided a ball almost seated on a valve seat between the inlet and outlet of that fitting. The restricted orifice between the ball and seat produces a pressure drop across each fitting while the flow of water therethrough causes oscillation of the ball on the valve seat which acts to break up small debris particles passing therethrough. Each fitting includes a threaded plug 69 opposite the inlet 68 for adjusting the clearance between the ball and the valve seat upon which the ball is arranged to be seated. The plug 69 has a tapered pipe thread and a stem which urges the ball toward the seat as it is screwed into the respective one of the female threaded pipe fittings 66A through 66C.

The solenoid valve 60 which controls the water supply to the injectors 58 is controlled by a micro switch 72 operated by a diaphragm 74. The diaphragm 74 is arranged such that upon being subject to a prescribed pressure the micro switch activates the solenoid of the valve 60 to supply water to the injectors. The pressure acting on the diaphragm is controlled by the components of the control reservoir 56 shown schematically in FIG. 2 and shown in perspective view in FIG. 6.

Figure 6:
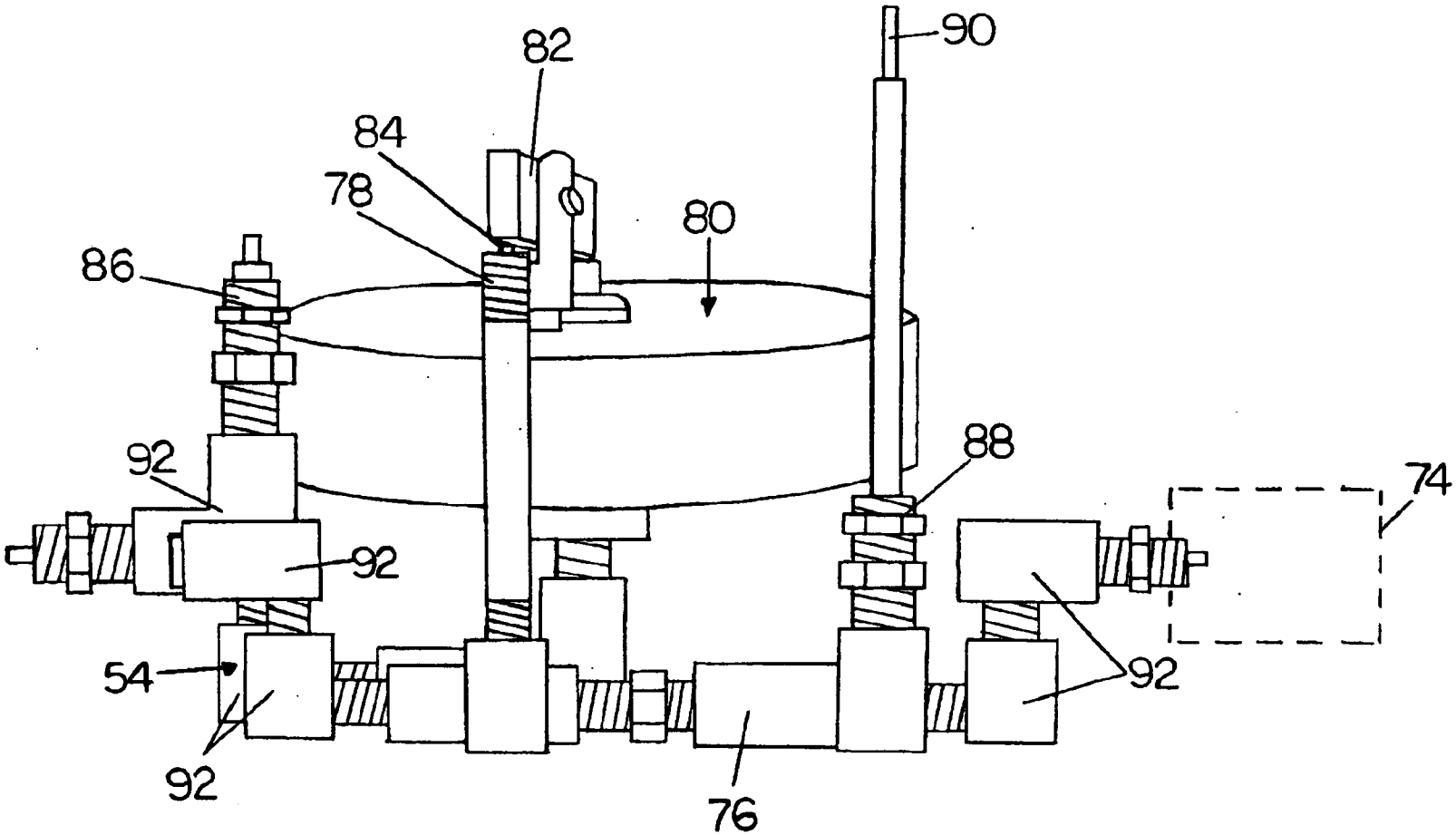
FIG. 6 is a perspective view of one of the level controls for a prescribed area of the expansive soil under a building foundation.

The components of the control reservoir 56 include a switch line 76 in the form of a foremost run in FIG. 6 which is coupled from the water supply 44 to the diaphragm 74 controlling the solenoid valve of the injector. When pressure in the switch line 76 reaches the prescribed pressure of the diaphragm 74 a solenoid valve 60 permits water to be supplied to the injectors. The switch line 76 is arranged to leak out at an overflow valve 78 to keep the pressure in the line down so as not to activate the diaphragm 74 and the injector 58 until the head pressure in the control line 54 indicates a big enough difference in elevation between the control reservoir and the reference reservoir.

The control line 54 within the control reservoir 56, illustrated as the rearmost run in FIG. 6, is coupled to a diaphragm 80 within the control reservoir which controls operation of the overflow valve 78. When the head pressure in the control line 54 is sufficiently high to indicate an elevation difference between the control reservoir and the reference reservoir, the diaphragm 80 is arranged to close the overflow valve 78 by deflecting a lever 82 coupled therebetween which seats a ball 84 on the overflow valve 78 to close that valve. When the valve is closed the pressure in the switch line 76 builds up until the diaphragm 74 activates the solenoid valve 60 and permits water to be injected into the soil by injectors 58.

The control line 54 includes a bleed valve 86 before being coupled to the diaphragm 80 operating the overflow valve to bleed out any air in the system in order for the system to operate properly. Once the air is bled out, the bleed valve 86 is maintained in a closed position.

The switch line 76 includes a high pressure limit valve 88 in addition to the overflow valve 78 to provide pressure relief thereby preventing unnecessary damage to the diaphragm 74 which the switch line 76 controls. The high pressure limit valve 88 generally comprises a check valve in which a rounded lower end of a weighted rod 90 is urged against a valve seat by the weight of the rod as it is slidably supported within a tubular guide aligned overtop of the valve seat. When pressure in the switch line is above an upper limit thereof water pressure urges the lower end of the rod away from the valve seat by lifting the weighted rod 90 within its tubular guide thus permitting water to overflow into the control reservoir 56 just as the overflow valve 78 overflows into the control reservoir 56 when it is open.

The control reservoir 56 includes a drain which drains excess water away under the basement floor. When the injectors of the level control system are used independently of the feed mechanism and drain mechanism the control reservoir 56 may drain directly to the catch basin or sump pit of the basement. The components of the control reservoir 56, namely the switch line 76 and the control line 54 include 90 degree bends 92 formed at each end thereof within the control reservoir to permit the lines to be recessed into the control reservoir while reducing the possibility of water leaking through the reservoir walls at the point where the lines pass therethrough.

The building leveling system 10 prevents drying of the soil under spread footings and basement floors of new buildings thereby preventing settlement in those regions where the soil shrinks on drying and swells on wetting. This system will also restore the moisture content where drying has already occurred and raise buildings to offset the consequential settlement.

There are three basic types of arrangements of the system. A type 1 arrangement is for new buildings installed before settlement has occurred as a preventative measure, and can also be used for buildings which have suffered only minor settlement. The type 1 arrangement does not require the use of the additional injectors 58 inserted below the foundation of the building. A type 2 arrangement is intended for use on buildings in which major settlement has occurred to accelerate the absorption and adsorption of water into the soil. The additional injectors 58 are employed in the type 2 arrangement in addition to the feed mechanism of the type 1 arrangement for maintaining the water levels adjacent the foundation.

Referring again to the accompanying drawings, the riser/standpipe 34 is inserted into the hub of an existing catch basin trap and is terminated one to two inches below the existing catch basin ring. This ring is flush at a top side with the top surface of the existing concrete basement floor. A perforated steel plate normally seats in the catch basin ring so as to support any loads that may be placed on it. The bottom end of the standpipe is sealed into the hub with a compressed gasket. The area between the standpipe and the catch basin walls is filled with water that is held back under the floor by the standpipe. This water is approximately ¾ of an inch below the top of the standpipe except when groundwater is entering the drain tile system which then overflows the standpipe and drains away to the sewer or sump pit. Depending on the type of soil, a fraction of the water injected into the soil may find its way to the space under the floor and drain away at the standpipe. Drainage tile and stone under the floor permit this water to pool as it is delivered into the space below the floor by the float valve of the feed mechanism.

Pressured water is supplied to the well 38 of the feed mechanism through a ¼ inch plastic tubing. The cylindrical member, collar 40, defining the basin of the feed mechanism is inserted into the existing concrete floor through a hole sawed through the floor slab. Three screws are screwed outward to engage the sawed cylindrical wall in the slab so as to retain whatever adjustment is made of the feed mechanism. The float valve 46 of the feed mechanism is adjustable by providing one or more weighted discs 48 which can be attached to the float arm of the float valve to raise or lower the water level to the desired height below the top surface of the floor.

The feed mechanism including the float valve, and the drain mechanism including the standpipe, define a type 1 arrangement of the system which should be in operation at all times to maintain uniform moisture content of the soil. As noted below however, in areas where clays have much greater expansive characteristics, such as illite and montmorillonite, keeping the type 1 components in operation may not be possible Where major settlement has occurred, a type 2 arrangement is included which, in addition to the components of a type 1 arrangement of the system, includes an appropriate number of the injectors 58, as noted above, fed with pressured water delivered through restricted orifices. These injectors are simply ¼ inch plastic tubing which deliver water to the clay approximately 7 feet below the basement floor to speed up the water absorption and adsorption process. The level control system 49 shuts down the injectors as the building reaches a level state.

The absorption and adsorption of moisture by the soil is a slow process. Accordingly, restricted orifices are employed which deliver water at a rate of approximately one drop per second per orifice. In one embodiment a water filter can be used to prevent debris, including microorganisms, from plugging these orifices. In a further embodiment, the restricted orifice includes a minimum of three orifices in fittings 66 in series with each other instead of a filter. Depending on the amount of debris that is experienced, the number can be increased to six or more, if desirable. The more orifices, the lower the pressure drop across each of them, and accordingly, the lower the pressure drop, the greater the clearance between the seat and the ⅛ inch ball within each fitting 66. This ball tends to oscillate around the centerline of the seat and this action tends to break up any debris. This orifice however does plug up if clearances are not adequate.

The velocity of flow through the orifice of each fitting 66 depends on the square root of the pressure acting across it. In other words, $v=\sqrt{2gh}$ where 'v' is the velocity in feet per second, 'g' is 32.2 feet/sec/sec and 'h' is the pressure in feet of water column. Because of this relationship, the doubling of the number of orifices in series increases the above clearance by only 41% for the same flow rate. The desirable flow rate is one 3⁄16 inch diameter drop per second, per injector.

The water pressure can be lowered in pressure from a supply of greater pressure to serve the injectors which permits greater clearance between seat and ball of the injectors. Because a pressure regulating valve that works with as little as 0.01 Imperial gpm flow rate is not readily available, a restricted orifice is used to reduce the pressure serving the solenoid operated valve 60 controlling flow of water to the injectors 58. With this arrangement, the inclination is to work with full pressure and increase the number of restricted orifices in series, if necessary, to keep free of plugging.

As debris works its way through the series of restricted orifices, the tendency for debris to restrict the opening of any orifice results in increased pressure across this orifice tending more so to force the debris through it.

The triplex restricted orifices in the form of the fittings 66A, 66B and 66C used in the bank of restricted orifices 64 for the injectors and illustrated herein are readily available, but in further embodiments, a plastic block which is drilled and tapped into a compact, neat assembly of six or more restricted orifices in series may be desirable for ease of manufacturing. Clearances between the ⅛ inch ball and seat can be factory set for a range of pressures.

Referring now to the triplex restricted orifices of the fittings 66, pressurized water enters the triplex orifice through the male connector at inlet 68 which has been plugged, drilled with a 0.026 inch diameter drill and installed in the fitting 66A. A plug 69 which has been fitted with a ⅛ inch diameter stem is screwed into that fitting 66A with a ⅛ inch diameter plastic ball held against the drilled orifice by the above stem of the plug. A hex nipple has also been plugged, drilled with an orifice and screwed into the fitting 66A to define the outlet 70 thereof. The nipple at the outlet 70 is also screwed into the inlet 68 of the second fitting 66B, so that the drilled orifice similarly engages a ⅛ inch diameter plastic ball. This ball is held against this seat by another plug 69. Finally, a hex nipple joins the outlet 70 of fitting 66B with the inlet 68 of fitting 66C. A plug 69 in the third fitting 66C holds a third ⅛ inch ball against the seat installed in the last nipple. The last fitting 66C is connected by a male connector at its outlet 70 with plastic tubing connecting to the respective injector 58. The fittings drilled with a 0.026 inch diameter drill are chamfered at 45 degrees from the orifice which increases the ability of the debris to clear the opening.

Each injector is equipped with a pressure gauge which indicates the pressure within the injector. If this gauge reads zero, this indicates that the restricted orifice may be plugged. Normally, this gauge reads from 3 to 8 psi which is the back pressure due to resistance of the clay to the water injection.

The reference reservoir 50 serves as a reference level of the system and is located at the highest point in the basement by means of a flat member attached to two adjacent joists. An appropriate water level is maintained by a float valve in the reference reservoir which is connected to a source of water under pressure. Plastic tubing is coupled by fittings adjacent the bottom side of the reservoir and is routed to the level controls for each zone.

The plastic tubing routed from the reference reservoir to each level control preferably has an outside diameter of at least ⅜ inch. Water in ¼ inch tubing sitting idle over a period of months may freeze. This freezing is caused by the phenomenon known as capillary attraction which is defined as the force that results in the raising of the surface molecules of a liquid in contact with a solid surface when the attraction between the solid and the liquid molecules is greater than that between the liquid molecules themselves. In this application, the cylindrical mass of water within the tubing is almost horizontal so that there is little hydrostatic head acting on it. Under these conditions, surface tension acts over the entire surface of the water so as to prevent flow as long as the peripheral capillary attraction is occurring, due to mutual molecular attraction of the water molecules. By providing tubing in which the outer diameter is at least ⅜ inch with an inner diameter of ¼ inch, the hydrostatic head appears to be enough to overcome surface tension and prevent "freezing ".

Referring to each of the level control reservoir components as illustrated in FIG. 6, there are two parallel runs of brass fittings. The rearmost run, the control line 54, receives water from the reference reservoir of FIG. 5 and delivers it through two tees into a 90 degree fitting coupled to the underside of the diaphragm housing 80. The bleed valve 86 is provided for removal of air in the tubing and fittings from the reservoir so that the full hydrostatic head of the reservoir is applied to the diaphragm.

The foremost run, the switch line 76, receives water at the rate of one drop per second from a restricted orifice which is connected by a nipple through the wall of a plastic container in which the components of the level control are located. This water travels through a series of fittings connected finally to the diaphragm housing 74 which operates the micro switch 72 controlling the solenoid actuated valve 60 supplying water to the injectors 58. When the pressure acting on this diaphragm reaches 28 to 30 inches of water column, this micro switch energizes the solenoid valve which supplies pressured water to the injectors.

If the flat member mounted on the bottom chord of adjacent joists, on which the level control components of FIG. 6 are supported, is sufficiently low with respect to the water level in reference reservoir of FIG. 5, then the hydrostatic head will act on the underside of the diaphragm 80 and thrust the stem of the diaphragm upward. Upward movement of the stem pivots the lever 82 for closing the overflow valve 78. The delivery of one drop per second leaks out of the overflow valve until this condition is achieved so that pressure builds up in the foremost run of fittings and operates the micro switch to provide water to the injectors. In this way, injectors deliver water into the soil as long as the above joists are below level. When they are level, the hydrostatic head is reduced so that the overflow valve 78 opens, releasing the pressure from the diaphragm operated switch so that the solenoid valve 60 is de-energized and the injectors are shutdown.

Mounting level controls to the underside of concrete floors or steel beams in place of joists as described above may require various mounting arrangements more suitably adapted to the particular location upon which the level controls are to be mounted.

The weighted high pressure limit valve 88 is a pressure relief valve which permits a one drop per second flow to escape from the fittings of FIG. 6 in the event the pressure exceeds a maximum pressure of the system. When pressure builds up in the foremost run because the overflow valve is closed and reaches 30 inches of water column, the pressure relief valve 88 is unseated to prevent pressures that could damage the diaphragm that operates the micro switch. The weighted pressure relief valve is a high pressure limit control.

The water that issues from the foremost run collects in the plastic container in which the components illustrated in FIG. 6 are mounted. A fitting in the wall of the container at the bottom drains the accumulated water through tubing into the space below the concrete floor. The level controls regulate to a tolerance of plus or minus 3/16 of an inch.

Figure 7:
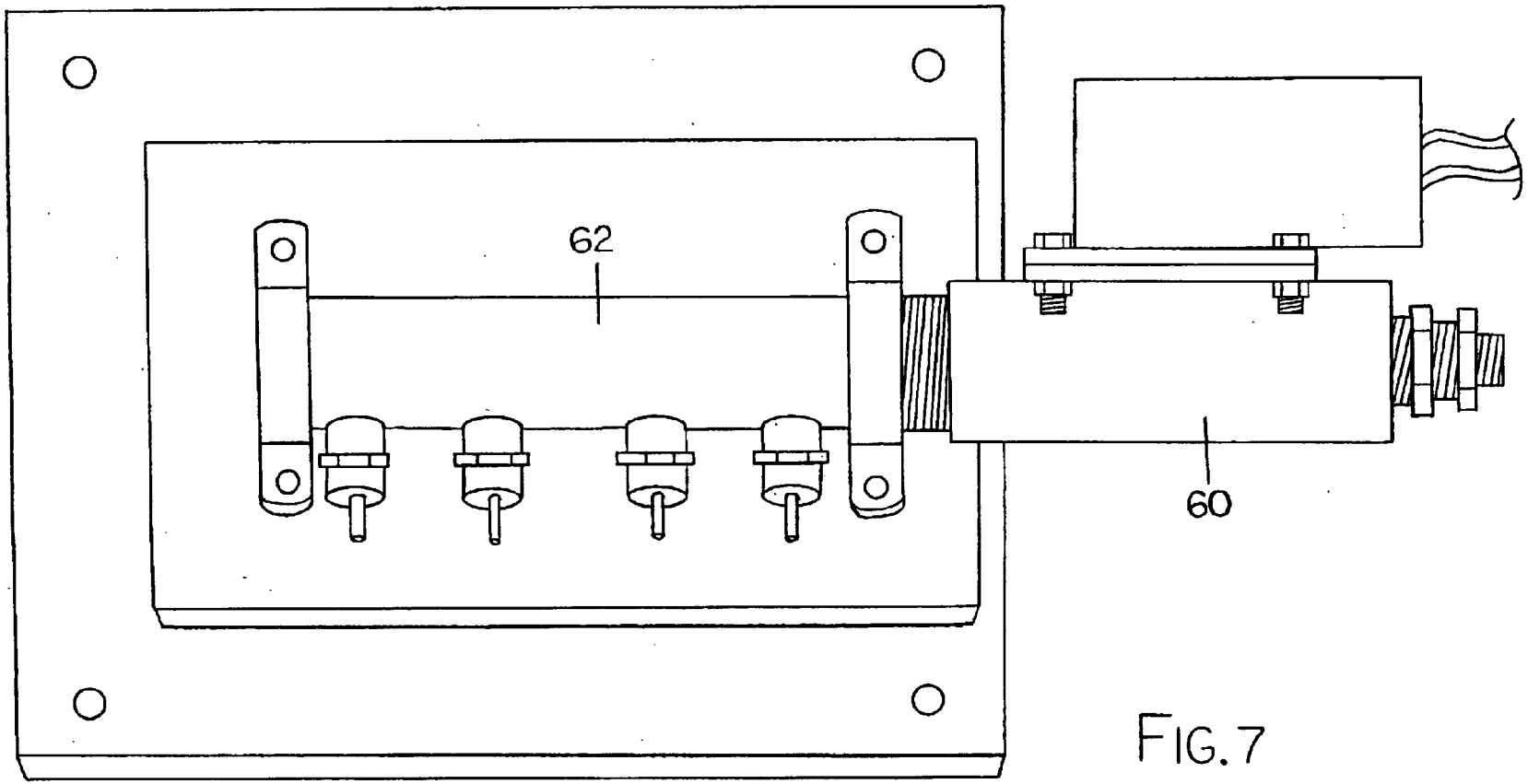
FIG. 7 is a perspective view of a solenoid actuated valve controlling water to a manifold supplying the injectors.

Pressured water is supplied to the injectors through the manifold 62 illustrated in FIG. 7. Water enters through the solenoid actuated valve 60 when energized. This water passes through the manifold into plastic tubing tied to restricted orifices serving the injectors. To minimize transmission of the 60 hertz vibration of the solenoid, the manifold is attached to a block which is secured to a resilient pad by screws that are passed through the pad from behind as illustrated in FIG. 7. The pad is loosely secured to the side of a joist by two screws.

Once a building is restored to a level state, the injectors may be removed for aesthetic purposes and the type 1 components, i.e., a standpipe and float assembly, would maintain a water level in the space below the floor. Provided the building is equipped with either a moisture barrier or other means that counteracts capillary action of the soil tending to lower its moisture content, the type 1 components would prevent subsequent settlement.

If not so equipped, the injectors would likely need to be installed again adjacent the outside of the walls and be fed from an unfinished area of the building with injector lines routed in a shallow trench. The injector lines would be downturned at appropriate intervals and terminated below the footings. Such a system would operate in non freezing weather only when it is needed to counter the above capillary action.

This is appropriate for soils in many areas where the absorption and adsorption of the soil is limited, however in areas where clays have much greater expansive characteristics, such as bentonite and montmorillonite, keeping the type 1 components in operation may not be possible. A structure could rise continuously at an imperceptible rate especially if it rose uniformly. After some time, such a rise could cause damage to the underground services such as water, sewer and electrical lines.

It may be useful to install a lengthy rod into the ground freely through the basement floor which would be stationary. A micro switch could be affixed to the structure so as to be engaged with the above rod. As the structure moved upward, the micro switch eventually would become disengaged from the rod thereby interrupting the power supply to a solenoid valve to shutdown the pressured water supply to the type 1 components. If settlement recurred, the switch would again be engaged by the rod and water would be supplied to the space under the floor to prevent settlement.

When the building drains to a sump pit, as shown in dotted line in FIG. 1, the float sensor 36 and related sensor actuated pump switch controls the sump pump so as to cease pumping when the water level is ¾ inch above the level of the water sustained by the float valve of the feed mechanism. The injectors in this arrangement would operate similarly to the injectors and level control system described above.

The standpipe used in systems which drain directly to sewer can be fitted with a backflow preventer. If the preventer is closed for quite some time due to high water levels caused by springtime flooding for example, the water absorption system should be shutdown until normal groundwater and outdoor sewer levels are restored.

More recent construction is equipped with a sump pit and pump for disposing of groundwater and would be subject to flooding of the basement during a lengthy power failure if water was above the level of the basement floor and emergency power was not available. This is true with or without the building leveling system being installed. If emergency power is likely unavailable, a safeguard is provided in the form of a switching arrangement, operable while power was still available, which overrides the float switch and operates the sump pump regardless of the level of the water in relation to the prescribed limits of the building leveling system. This would allow the sump pump to lower the water level under the floor to the underside of the drainage tile. At the same time, this switching arrangement would de-energize a solenoid valve interposed between the water supply and the float valve supplying water to the feed mechanism and injectors. The value of this arrangement is the draining of the drainage tile and stone before a potential power failure which would provide possibly as much as twelve hours of time during which groundwater could accumulate in the drainage tile and stone under the floor as well as in the sump pit.

For buildings that are finished in the basement, injectors can be installed outside to avoid drilling holes through finished floors. These injectors would be operational during non freezing temperatures only.

Buildings having a split level basement or foundation are particularly susceptible to damage resulting from differential rates of settling. In a split level basement foundation for example, a shallower crawlspace section is expected to sink more so than a deeper full basement section of the foundation. The shallow footings are responsible for this differential settlement as the stack effect has a much shorter route through the soil and into the crawlspace. The greater influx of very dry winter air around the footings and over the exposed crawlspace soil results in more rapid shrinkage and settlement. Capillary action in the soil during summer months would dry out the soil under shallow footings at an even greater rate than that affecting the deeper footings due to the shorter route to the surface.

The space under the shallow footings however cannot be flooded as in the foundation of a typical building. Perforated pipe below the shallow footings may be employed to wet the soil with a restricted orifice serving the perforated piping to keep the moisture content constant.

For finished basements, injectors can be installed outside along those basement walls that are finished on the inside. A 12 inch deep trench can be dug one foot wide adjacent to the basement walls and ¼ inch plastic tubing laid therein. At approximately 7 foot intervals, a ¾ inch diameter hole is drilled in the soil to a depth of 12 feet for each injector. This injector is simply ¼ inch diameter plastic tubing with its lower end open. All restricted orifices will be kept inside the house and will serve rather long lengths of tubing. This trench will be covered with soil to avoid tampering. Routing of tubing to the outdoors will be done through an existing basement window in an unfinished area.

A type 3 arrangement of the system 10, using only the injectors without the components of the type 1 arrangement for maintaining the water level at the foundation, can be useful to minimize the settlement that occurs in semi-arid climates during the arid periods. By pre-wetting the soil before a building is built, and by installing a type 1 or, possibly, a type 2 arrangement after it is built, the building movement should be minimized. In the type 3 arrangement, 1 to 3 years for example before a site is excavated for construction, injectors would be installed at the site deep enough for their tips to be 5 to 8 feet below the footing level of the proposed structure. Water would be delivered through restricted orifices to all injectors.

The components of the building leveling system are simple in construction and readily installed. The only other arrangement for counteracting settlement requires major activity such as backhoe excavation or, if machine access is not possible, hand digging down to below the footings for jacking.

In differing types of soil, it may be desirable, for example in the British Isles, to pre-wet a site before construction of a building by using injectors to swell the soil before excavating. The soil in that area is known to be subject to shrinkage. By swelling the soil before construction and sustaining this state with this building leveling system, stability can be provided. In semi-arid climates the building system is particularly advantageous. In warm climates, for example some parts of the southern United States of America, the phenomenon of stack effect is not present so flooding the space under the floor may not be necessary. It is conceivable that smectite clays expand with such rapidity to provide a tight seal around the ¼" tubing of the injectors to achieve expansion at greater depth without flooding the space under the floor.

In place of the injectors described above, a system of reverse electro-osmosis may be employed for injecting the water into the soil spaced below the foundation. Electro-osmotic de-watering systems have been employed to de-water fine-grained soils. They are usually applicable to silts within a certain plasticity range, although the specific range of applicability is not clearly defined. An electro-osmotic system is basically a well-point system in which the gradients causing flow are supplemented by the use of direct current electricity. Electrodes are inserted midway between adjacent well points. Direct current is applied so that the polarities of the well point and the electrode result in an electrical gradient causing the positive ions in solution in the groundwater to migrate toward the negatively charged well point. The mobility of the water to the well point is thereby improved. By properly locating the well-point electrode system, the stability of excavation slopes improved. This system includes well points spaced typically 30 feet apart with electrodes between the soil. The well points and the electrodes are maintained by a D.C. power supply at opposite polarity in such a way as to accelerate de-watering of the sloped wall of an excavation for stability.

In a reverse electro-osmosis system water is injected into the soil instead of removed from the soil at and below the footings. The plastic tubing injectors are replaced with stainless steel tubing. Electrodes are installed between the injectors and will be sustained at opposite polarity by a D.C. power supply so as to accelerate absorption and adsorption of water by the soil. Reverse electro-osmosis serves to speed up the rise of a building to a level state.

While various embodiments of the present invention have been described in the foregoing, it is to be understood that other embodiments are possible within the scope of the invention. The invention is to be considered limited solely by the scope of the appended claims.

What is claimed is:

1. A building levelling system for a building having a basement with a floor and footings supported on expansive soil, the building levelling system comprising:

a water management system arranged to maintain water in the expansive soil below the floor at a level which is adjacent the basement floor, the water management system including:

a drain mechanism for draining water from said expansive soil below the floor when the level of water rises above a prescribed upper limit of the water management system adjacent the floor; and a feed mechanism for feeding water into said expansive soil below the floor when the level of water falls below a prescribed lower limit of the water management system adjacent the floor.

2. The building levelling system according to claim 1 wherein the prescribed upper limit is below a top surface of the basement floor.

3. The building levelling system according to claim 1 for a building having drainage tiles below the basement floor wherein the prescribed lower limit is above the drainage tiles.

4. The building levelling system according to claim 1 wherein the prescribed upper limit and the prescribed lower limit are spaced apart.

5. The building levelling system according to claim 1 wherein the upper limit is situated between a top surface and a bottom surface of the basement floor and the lower limit is spaced below the upper limit.

6. The building levelling system according to claim 1 wherein the feed mechanism includes a supply of water and level sensor arranged to determine when the level falls below the prescribed lower limit of the water management system.

7. The building levelling system according to claim 6 wherein the level sensor comprises a float valve coupled to the water supply and arranged to be supported adjacent the basement floor.

8. The building levelling system according to claim 6 wherein the level sensor is adjustable over a range of selected levels.

9. The building levelling system according to claim 1 for a basement floor having a catch basin with a drain adjacent a bottom end of the catch basin wherein the drain mechanism comprises a riser coupled to the drain to extend upwardly from the bottom end of the catch basin.

10. The building levelling system according to claim 9 wherein the prescribed upper limit comprises an open top end of the riser.

11. The building levelling system according to claim 9 for a basement floor having a sump pump in a sump wherein the drain mechanism includes a level sensor for determining a level of water in the sump and a sensor activated switch for operating the sump pump only when the level of water in the sump exceeds the prescribed upper limit.

12. The building levelling system according to claim 11 wherein there is provided an override switch for overriding the sensor activated switch and operating the sump pump regardless of the level of water in the sump.

13. A building levelling system for a building having a foundation supported on expensive soil, the building levelling system comprising:

an elevation level sensing mechanism for determining when an elevation level of the foundation above a prescribed area of the expansive soil falls below a reference elevation level of the system; and a water injection system for feeding water into the prescribed area of the expansive soil below the foundation when the elevation level sensing mechanism determines that the elevation level of the foundation above the prescribed area of the expansive soil has fallen below the reference elevation level of the system.

14. The building levelling system according to claim 13 wherein the water injection system is arranged to inject the water into the prescribed area of the expansive soil at a location spaced below the foundation.

15. The building levelling system according to claim 13 wherein the level sensing mechanism is arranged to determine when an elevation level of the foundation in any one of plural prescribed areas of the expansive soil falls below the reference elevation level of the system and the water injection system is arranged to inject water into one of the prescribed areas when an elevation level of the foundation in said one of the prescribed areas falls below the reference elevation level.

16. The building levelling system according to claim 13 wherein the water injection system is arranged to inject the water into the prescribed area of the expansive soil approximately 7 feet below the foundation.

17. The building levelling system according to claim 13 wherein the water injection system is arranged to inject the water into the prescribed area of the expansive soil at a rate of approximately one drop per second.

18. A building levelling method for levelling a building having a foundation supported on expensive soil, the building levelling method comprising:

establishing a reference elevation level of the foundation;

providing an elevational level sensing mechanism for a prescribed area of the expansive soil for sensing an elevation level of the foundation above the prescribed area of the expansive soil relative to the reference elevation level;

providing a water injection system below the foundation in the prescribed area of the expansive soil; and feeding water into the prescribed area of the expansive soil below the foundation using the water injection system when the level sensing mechanism determines that the elevation level of the foundation above the prescribed area of the expansive soil has fallen below the reference elevation level of the system.

19. The method according to claim 18 including injecting the water at a rate of approximately one drop per second.

20. The method according to claim 18 including locating the reference elevation level at a highest elevation of the foundation where the expansive soil is most stable.

* * * * *